United States Patent [19]

Dumenil et al.

[11] Patent Number: 4,614,060

[45] Date of Patent: Sep. 30, 1986

[54] AUTOMATICALLY ACTUATED SEAL FOR SEALING BUILDINGS, PARTICULARLY DOORS AND WINDOWS

[76] Inventors: Claude G. Dumenil, 6, rue Lenepveu, 76000 - Rouen; Louis P. Dumenil, 3550 Route de Neufchatel, 76230 - Bois-Guillaume, both of France

[21] Appl. No.: 488,719

[22] Filed: Apr. 26, 1983

[30] Foreign Application Priority Data

Apr. 26, 1982 [FR] France ..... 82 07141

[51] Int. Cl.[4] ..... E06B 7/20

[52] U.S. Cl. ..... 49/303; 49/310; 49/312

[58] Field of Search ..... 49/303, 304, 305, 310–315, 49/489, 383

[56] References Cited

U.S. PATENT DOCUMENTS 2,694,234 11/1954 Roby et al. ..... 49/383

3,411,246 11/1968 Miller ..... 49/489 X

FOREIGN PATENT DOCUMENTS 2815244 4/1978 Fed. Rep. of Germany ..... 49/310

*Primary Examiner*—Kenneth Downey

*Attorney, Agent, or Firm*—Brisebois & Kruger

[57] ABSTRACT

Automatically actuated seal constituted of a profile molding connected to a movable panel in a frame, a sill, or a portion of the casing of the frame, and having an elongated sealing element, mounted in a groove of the profile molding and able to be displaced between a retracted position and a projecting sealing position under the effect of an actuating device lodged in the profile molding and having a sealing joint with several legs, one of which is connected to the sealing element and another to the profile molding.

This sealing joint has three legs (16, 17, 18) extending from a junction region (15) forming a hinge, one of the legs (16) making the sealing contact, the second leg (17) being connected to the sealing element by being fastened in a slot of this latter, and the third leg (18) comprising means for fastening on the profile molding, or in a channel lodging this latter, the first (16) and third (18) legs being so disposed as to form a separating barrier in the sealing position between the groove (13) housing the sealing element (11) and the surrounding environment outside the said movable panel (3).

7 Claims, 4 Drawing Figures

Figure 1:
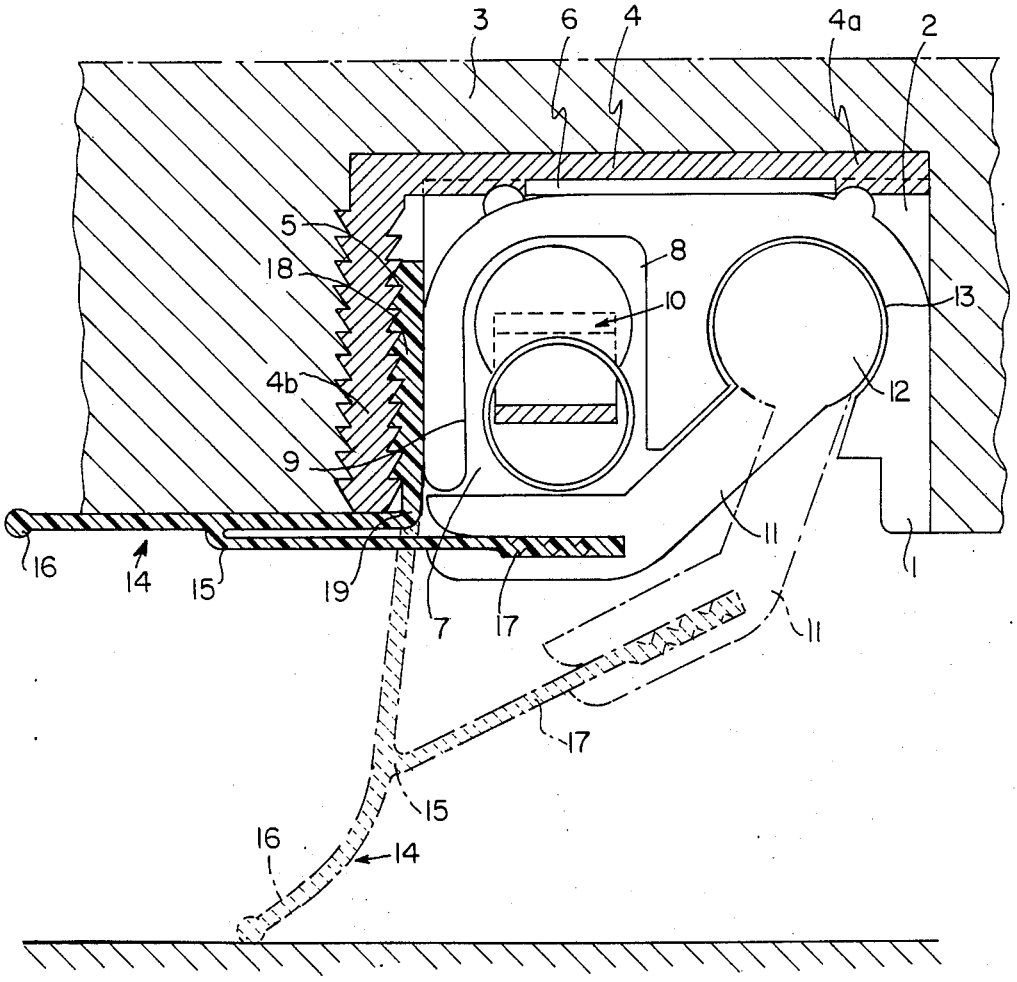

AUTOMATICALLY ACTUATED SEAL FOR SEALING BUILDINGS, PARTICULARLY DOORS AND WINDOWS

The present invention relates to an automatically actuated seal for closures in buildings, particularly doors and windows.

The device according to the invention is more specifically of the type constituting a profile molding comprising an elongated sealing element able to be displaced by pivoting or by vertical translation between a retracted position and an extended sealed position under the effect of an actuating device positioned in a groove of the profile molding.

The device according to the invention can constitute an automatice base seal, in which case the profile molding is designed to be fixed, on a panel, particularly a door, movable in a frame, or an automatic sill, in which case the profile molding is lodged in a channel made in the sill. The device according to the invention can also be mounted on a part of the casing of the door frame along a vertical upright of the door frame or the upper horizontal crosspiece.

Automatic base seals using the principle described above are for example described in Applicants' French Pat. Nos. 76.20773 and 77.12517 as well as their certificate of addition No. 79.12424.

The base seals described in these documents include a profile molding which can be fastened to a surface of a panel or be lodged in a groove in a channel made in the lower edge of the panel.

Other types of seals are known which use a sealing element movable, in vertical translation or by pivoting, and which include a sealing joint with several arms, one of which is connected to the sealing element and another to the profile molding housing the sealing element. One device of this type is described in German patent application No. 28 15 244.

The known seals have certain disadvantages when used under rigorous climatic conditions due notably to the fact that when the sealing device is in the operating position, the actuating device and the movable sealing element are not insulated with respect to the exterior so that their operation may be affected by phenomena, such as frost resulting from condensation, associated with the climatic factors such as intense cold.

The present invention aims specifically to provide a seal of very small size and space requirement which provides for reliable operation even under particularly unfavorable climatic conditions. The seal arrangement according to the invention is characterized essentially by the fact that it includes three legs extending from an intersection region forming a hinge, one of the legs being designed to make the sealing contact, the second leg being connected to the sealing element by being fastened in a slot of this latter, and the third leg including means for its fastening on the profile molding or a channel housing this latter, the first and third leg being placed so as to form a separating barrier in the sealing position, between the channel housing the sealing element and the exterior ambiant environment around the movable panel.

The third leg of the joint is advantageously mounted between the external surface of one wing of the profile molding and the wall of the channel housing the profile molding, or between one wing of the profile molding and a supplementary section, connected or not to the profile molding lodged in the channel, with a spacing with respect to the profile molding for receiving the leg of the joint, the leg then being fastened on the wing of the profile molding and/or on the surface facing the channel or the section.

The wall of the channel or the section, facing the third leg of the sealing joint advantageously comprises engagement means, for example teeth or serrations, to ensure the retention of the leg of the joint.

Figure 2:
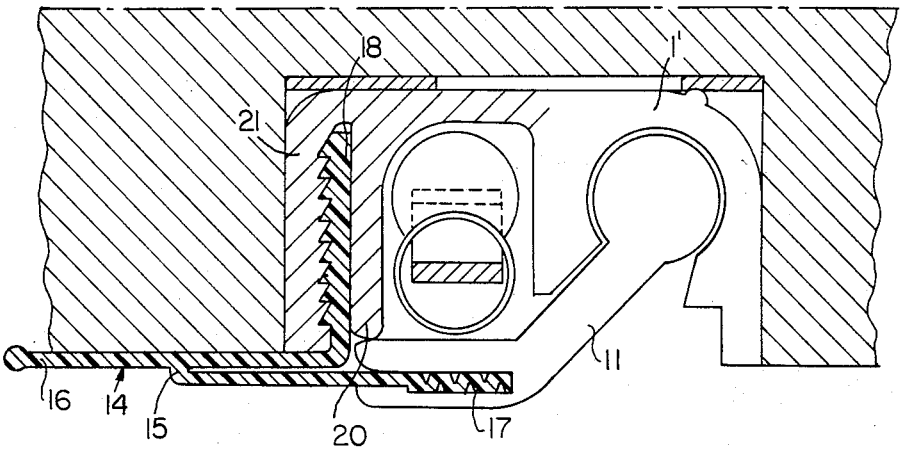
Figure 3:
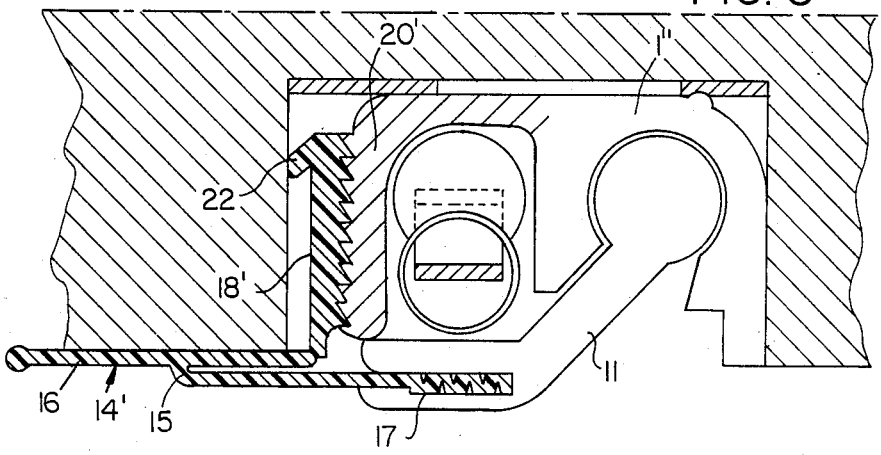
Figure 4:
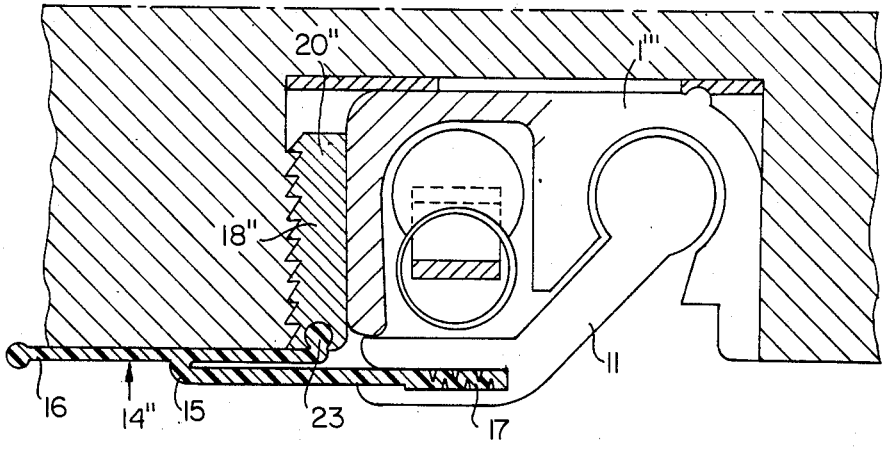

In order to make the invention better understood, one embodiment will now be described as a wholly non-limiting example with reference to the attached drawings in which:

FIG. 1 is a view in section of an arrangement according to the invention showing a base seal mounted in a groove in a panel, the sealing element and the sealing joint being shown in two positions of operation, FIG. 2 is a view similar to that of FIG. 1 of a second embodiment, FIG. 3 is a view similar to that of FIG. 1 of a third embodiment, and FIG. 4 is a view similar to that of FIG. 1 of a fourth embodiment.

The base seal of the embodiment shown is similar in structure and operation to that described in Applicants' certificate of addition No. 79 12 424.

It is composed of a profile molding 1 having in cross-section the general shape of a U, this profile molding being fastened in a channel 2 which is essentially rectangular in cross-section and which is made in the lower edge of a movable panel such as a door 3, the channel having a width significantly smaller than the thickness of the panel.

According to the invention, channel 2 is larger than would normally be necessary to receive profile molding 1 to allow lodging of one leg of the sealing joint or seal gasket as will be explained below.

According to the invention, there is in the channel an L-shaped section 4, one wing **4*a* of which occupies the base of the channel and the perpendicular wing 4*b* has toothed walls 5**.

In the embodiment shown, profile molding 1 is fastened by an adhesive strip 6 at its upper part against wing **4*a* of section 4 lodged in the base of channel 2**.

Profile molding 1 has an internal groove 7 having a trough-shaped cross-section with essentially parallel side walls 8 and 9, in which groove is lodged an actuating device 10 which can advantageously be of the type described in certificate of addition No. 79 12 424.

It is not necessary to discuss the structure and operation of such an actuating device in detail since these are described in the above-mentioned certificate of addition.

This actuating device is arranged to cause pivoting of an elbow shaped sealing element 11 between a retracted position shown in solid lines corresponding to opening the panel, and a position shown in dot-dash lines corresponding to closing the panel. Sealing element 11 has an end 12 with a basically circular cross-section which engages in a groove 13, also of essentially part-circular cross-section, of profile molding 1.

Return means (not shown) are provided to bring the sealing element back into retracted position at the time of opening the panel.

The sealing joint according to the invention, designated overall by 14, has, extending from an intersection region 15, forming a hinge, a first leg 16 which is movable between the position shown in solid lines in the drawing, resting against the lower edge of the panel and a position shown in dot-dash lines forming sealing contact with the ground in the operating position of the base seal.

Joint 14 has a second leg 17, lodged in a slot of sealing element 11 in the elbow shaped end of the latter opposite that engaging in groove 13.

Finally, the joint has a third leg 18 engaged and immobilized between the facing wall of wing **4*b* of section 4 and the corresponding exterior wall of profile molding 1**.

As may be seen from the drawings, the sealing joint also has in addition to hinge region 15, a second hinge region 19 essentially at the level of the edge of the panel, this double hinge providing the advantage that in the retracted position the device projects only slightly from the profile molding in which it is mounted.

As can be seen on FIG. 1, due to its design and its arrangement, the sealing joint, in both the retracted position, shown in solid lines, and in the operating position of the base seal, shown in broken lines, forms a barrier of separation between groove 7 housing actuating device 10 and groove 13 lodging the sealing element, for the exterior surrounding environment to the panel, that is to the left in FIG. 1.

The joint according to the invention is advantageously constituted of a flexible strip, for example, made of a composite material formed from a glass cloth coated with a silicon elastomer, or from polyurethane or silicon elastomer, the strip having a small thickness on the order of several tenths of millimeters. Legs 16 and 17 have for example a thickness of about 3/10th to 7/10th of a millimeter and branch 18 has a thickness of 1 mm.

The seal shown in FIG. 2 is basically distinguished from that shown in FIG. 1 by the fact that profile molding 1' has a first wing 20 and a second wing 21 having a function comparable to that of wing **4*b* of section 4 of FIG. 1, and being provided with teeth cooperating with leg 18** of the joint.

Joint 14 shown in this second embodiment thus has the same structure as the joint of the embodiment of FIG. 1.

In the embodiment of FIG. 3, the joint, designated overall by 14', has two legs 15 and 16 having the same characteristics as legs 15 and 16 in the preceding embodiments, but on the other hand the third leg 18', made of a more rigid material than the other legs is fastened by serrations on wing 20' of profile molding 1''. In addition, leg 18' has, preferably near its end, and projecting toward the side opposite that fastened on branch 20', a flexible tongue 22 able to press against the adjacent wall of the channel.

In the embodiment of FIG. 4, sealing joint 14'' has two legs 16 and 17 like those of the preceding embodiments, but its third leg 18'', to which is fastened at 23, the end of leg 16, is actually constituted of a rigid part, made for example of aluminum, and has teeth acting with the wall of the channel, its other face to the right, resting against the exterior surface of wing 20'' of profile molding 1'''.

The various embodiments presented may naturally also be used when the device according to the invention is of the automatic sill type, the channel lodging the profile molding then being a channel made in the sill or threshold instead of being made in a groove in the movable panel.

Although the invention has been described in connection with particular embodiments, it is of course in no way thereby limited and may undergo numerous modifications in form or materials without exceeding either its scope of its spirit.

We claim:

1. An automatic seal arrangement, for a panel of a building moveable in an opening of the building, to seal between the interior of the building and the exterior ambient environment outside of the building, when the moveable panel is closed, said seal arrangement comprising, a profile molding adapted to be connected to a portion of the building adjacent the opening of the building, said profile molding having a groove, an elongated moveable seal member in said groove, a seal gasket having a first leg, a second leg, and a third leg extending from a junction zone forming a hinge, said first leg comprising means for sealing against a surface of the building, said second leg being secured to said seal member, and said third leg having an end secured relative to said profile molding at a location between said groove and the exterior of the building, means mounting said seal member in said profile molding for movement between a retracted position in which said seal gasket is retracted, and an extended position in which said first leg of the seal gasket is extended into sealing engagement with a surface of the building and said second and third legs diverge relative to each other, said second and third legs forming a barrier isolating the seal member relative to the ambient environment outside the building, at least in said extended position.

2. Seal arrangement according to claim 1, wherein at least the first and second legs of the seal gasket are comprised of thin flexible strips.

3. Seal arrangement according to claim 1 in which the profile molding is lodged in a channel of an element of the building, and the third leg of the seal gasket is fixed between an external surface of one side of the profile molding and a wall of the channel lodging the profile molding.

4. Seal arrangement according to claim 3 wherein a supplementary section is lodged in said channel in spaced relation to a wall of the profile molding for lodging said third leg of the seal gasket between said wall of the profile molding and said section.

5. Seal arrangement according to claim 1 wherein said profile molding has a second groove, and said third leg of the seal gasket is lodged in said second groove of the profile molding.

6. Seal arrangement according to claim 3 comprising retaining means in said channel for retaining the third leg of the seal gasket.

7. Seal arrangement according to claim 6 wherein said retaining means comprises serrations in wall engaging said third leg of the sealing gasket.

* * * * *